US008221063B2

(12) United States Patent
Wiesenberger

(10) Patent No.: US 8,221,063 B2
(45) Date of Patent: Jul. 17, 2012

(54) STEAM TURBINE WITH TWO STEAM CHAMBERS

(75) Inventor: Max Wiesenberger, Düsseldorf (DE)

(73) Assignee: Siemens Aktiengesellschaft, Munich (DE)

( * ) Notice: Subject to any disclaimer, the term of this patent is extended or adjusted under 35 U.S.C. 154(b) by 1049 days.

(21) Appl. No.: 11/660,638

(22) PCT Filed: Aug. 11, 2005

(86) PCT No.: PCT/EP2005/053954

§ 371 (c)(1),
(2), (4) Date: Jul. 2, 2008

(87) PCT Pub. No.: WO2006/021513

PCT Pub. Date: Mar. 2, 2006

(65) Prior Publication Data

US 2009/0116957 A1 May 7, 2009

(30) Foreign Application Priority Data

Aug. 23, 2004 (EP) ..... 04019959

(51) Int. Cl.
*F01D 1/00* (2006.01)

(52) U.S. Cl. ..... 415/184; 415/205

(58) Field of Classification Search ..... 415/108, 415/184, 187, 203, 204, 205, 224, 182.1, 415/183, 215.1, 226, 101, 102
See application file for complete search history.

(56) References Cited

U.S. PATENT DOCUMENTS

| | | | | |
|---|---|---|---|---|
| 1,273,633 | A * | 7/1918 | Ljungstrom | 415/62 |
| 3,915,588 | A * | 10/1975 | Brandstatter | 415/100 |
| 4,029,432 | A * | 6/1977 | Meylan et al. | 415/101 |
| 4,232,993 | A * | 11/1980 | Ikeda et al. | 415/103 |
| 5,123,812 | A | 6/1992 | Groenendaal, Jr. et al. | |

FOREIGN PATENT DOCUMENTS

| | | | |
|---|---|---|---|
| JP | 55031413 | A * | 3/1980 |
| JP | 2000 356110 | A | 12/2000 |
| JP | 2004 100482 | A | 4/2004 |

* cited by examiner

*Primary Examiner* — Edward Look
*Assistant Examiner* — Christopher R Legendre

(57) ABSTRACT

A steam turbine with at least two steam chambers, which are enclosed by a basically tubular casing and which are separated from each other by means of at least one partition which is arranged in the casing, is characterized according to the invention in that the partition is formed from at least two flat partial surfaces which are formed in an inclined manner relative to each other.

9 Claims, 4 Drawing Sheets

STEAM TURBINE WITH TWO STEAM CHAMBERS

CROSS REFERENCE TO RELATED APPLICATIONS

This application is the US National Stage of International Application No. PCT/EP2005/053954, filed Aug. 11, 2005 and claims the benefit thereof. The International Application claims the benefits of European application No. 04019959.8 filed Aug. 23, 2004, both of the applications are incorporated by reference herein in their entirety.

FIELD OF INVENTION

The invention relates to a steam turbine with two steam chambers which are enclosed by a basically tubular casing and which are separated from each other by means of at least one partition which is arranged in the casing.

BACKGROUND OF THE INVENTION

In steam turbines of the aforesaid type, individual steam chambers, in cylindrical turbine casings, are separated by partitions. Connections are provided on the casing for feed and exhaust of steam in the steam chambers.

The partitions, which separate the steam chambers from each other, at the same time must be producible simply and yet permanently withstand the compression stress which occurs. The connections must be formed with cross sectional areas which, in proportion to the fluid volumes which are to be guided through the steam chambers, are often dimensioned comparatively large.

Furthermore, the thermal expansion stresses, which arise in steam turbines on account of the high temperature differences, pose a large problem in the design of the casing and the associated partitions.

In known steam turbines, the individual steam chambers are separated by rotationally symmetrical, cone-shaped walls, on which the cone angles widen during temperature influence as a result of thermal expansion. This leads to relatively high expansion stresses on the partitions.

Furthermore, in known casings, the external surfaces of the individual steam chambers are partially only relatively narrow strips, on which space for arranging said connections is not adequately available.

SUMMARY OF INVENTION

The invention is based on the object of making available a steam turbine of this generic type in which especially low thermal stresses arise on the partitions but which at the same time is formed especially compactly.

The object according to the invention is achieved by a steam turbine of the type mentioned in the introduction, in which the partition is formed from at least two flat partial surfaces which are formed in an inclined manner relative to each other.

According to the invention, the partition which is to be provided in a casing of a steam turbine is not formed alone as a flat surface or as a curved surface, but there are creases or kinks, as the case may be, purposefully formed in the partition, by means of which flat partial surfaces adjoin each other. The walls which are creased in such a way can actually be produced by means of a creasing process or by means of connecting two flat pieces, for example by welding, depending upon size and thickness of the partition. By means of the creases, the partitions according to the invention, and especially their flat partial surfaces, expand uniformly, without particular change of shape, and no additional stresses are created on the associated casing. Furthermore, the creases lead to a stiffening of the walls and, as is subsequently explained in more detail, enable a more flexible partitioning of the steam chambers. With a corresponding design, a flat partial surface of a partition can be extended from the actual casing section and, therefore, can form a part of a wall of a connector on the casing. In this way, a more favorable introduction of external connection forces into the casing structure results.

The creases according to the invention are especially advantageously formed as straight crease edges, by which partial surfaces adjoin each other. Such straight crease edges can be inexpensively produced by means of simple kinking or by means of welding of straight plate edges.

Furthermore, it is advantageous if the partial surfaces which are formed with crease edges according to the invention, adjoin each other on crease edges which are asymmetrically arranged with regard to a longitudinal axis of the tubular casing. This has the effect that the partitions according to the invention not being constructed in an especially rotationally symmetrical manner. Such a design is especially of advantage with regard to the thermal expansion stresses which arise while the temperature is being maintained.

Furthermore, it is additionally advantageous, with regard to the development of stresses on the casing structure of the steam turbine according to the invention, if the partial surfaces are also asymmetrically arranged, especially not rotationally symmetrically arranged, in their inclination with regard to a longitudinal axis of the tubular casing. By means of a flexible design over the circumference of the casing, such partial surfaces, which are asymmetrically inclined with regard to the longitudinal axis of the tubular casing, especially also enable an improved location of entry openings, so-called manholes, through which the relevant regions inside the casing are better reachable over the operating period of the steam turbine.

A partition according to the invention which is to be developed and produced particularly cost-effectively is characterized in that it is formed with a central partial surface, to which is connected a plurality of additional partial surfaces, which are distributed over the circumference and which are inclined to the central partial surface. While the central partial surface for separating the steam chambers is provided directly on a rotor which rotates in the casing, the additional partial surfaces, which are distributed around this central partial surface, can be arranged in a differently inclined manner, depending upon the space requirement in the respective steam chambers and on the enclosing tubular casing. At the same time, comparatively simple crease edges and/or connecting edges result.

A further standardization of the partitions according to the invention, and a reduction of costs which is associated with it, is possible by connecting to the central partial surface inclined partial surfaces which are distributed over its circumference and which are the same size. In this case, the aforementioned asymmetrical design of the partitions according to the invention can be especially advantageously achieved by means of three inclined partial surfaces.

These three inclined partial surfaces, for example, can be advantageously arranged on one side in each case of a basically rectangular central partial surface, wherein the central partial surface itself is formed on the fourth side of the basically rectangular basic shape such that it continues flat up to the casing.

With regard to the partition according to the invention, it is further advantageous if the central surface is oriented basically perpendicularly to a longitudinal axis of the tubular casing and, as a result, perpendicularly to a rotor which rotates in the casing.

As has already been indicated above, a connector, which serves as a connection on the casing, can also be at least partially formed by the partial surfaces which according to the invention are inclined. Furthermore, it is also advantageous if an inlet or outlet, which is funnel-shaped at least on one side, is formed by one of the inclined partial surfaces inside the casing. Such funnel-shaped inlets or outlets create the fluidically desired narrowing or widening in each case of the cross sectional areas of the associated flow paths in the steam turbine according to the invention.

Furthermore, according to the invention it is proposed that in a steam turbine of this generic type at least two connections for steam are formed on the casing in such a way that one of the steam chambers has decreasing cross sectional areas or cross sectional widths, as the case may be, in the direction from an associated connection into the casing, while the steam chamber which is located on the other side of the partition has increasing cross sectional areas or cross sectional widths, as the case may be, in the direction towards an associated connection from the casing. The decreasing cross sectional areas, therefore, are arranged directly next to increasing cross sectional areas and so altogether lead to an especially compact and space-saving construction of such a steam turbine according to the invention. Especially in the case of a very limited axial constructional length of the tubular casing, adequate space for the location of connections on the external sides of the casing can be created as a result of the design of separating surfaces according to the invention. At the same time, the cross sectional progressions along the flow paths into the individual steam chambers are designed according to the reducing space requirement, for example in the case of an inlet with increasing distance from the inlet connector. According to the invention, the region with small space requirement of a steam chamber lies next to the region with large space requirement of the adjacent steam chamber. A comparatively short constructional length of the tubular casing, with an especially favorable utilization of space, ensues as a result of this.

BRIEF DESCRIPTION OF THE DRAWINGS

An exemplary embodiment of a steam turbine according to the invention is subsequently explained in detail with reference to the attached schematic drawings. In the drawings.

DETAILED DESCRIPTION OF INVENTION

Figure 1:
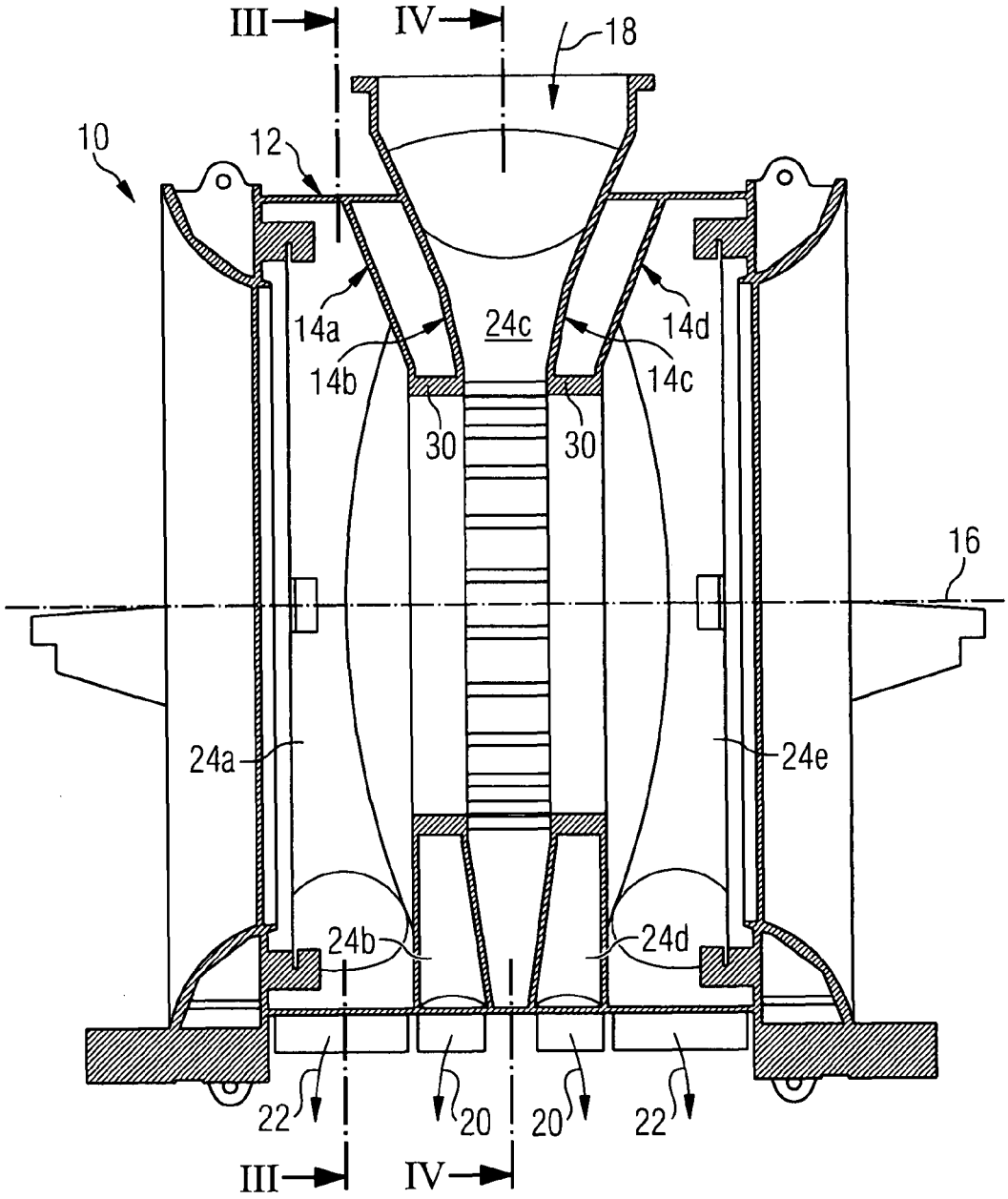
FIG. 1 shows a half-section of an exemplary embodiment of a casing, with partitions, of a steam turbine according to the invention.
Figure 2:
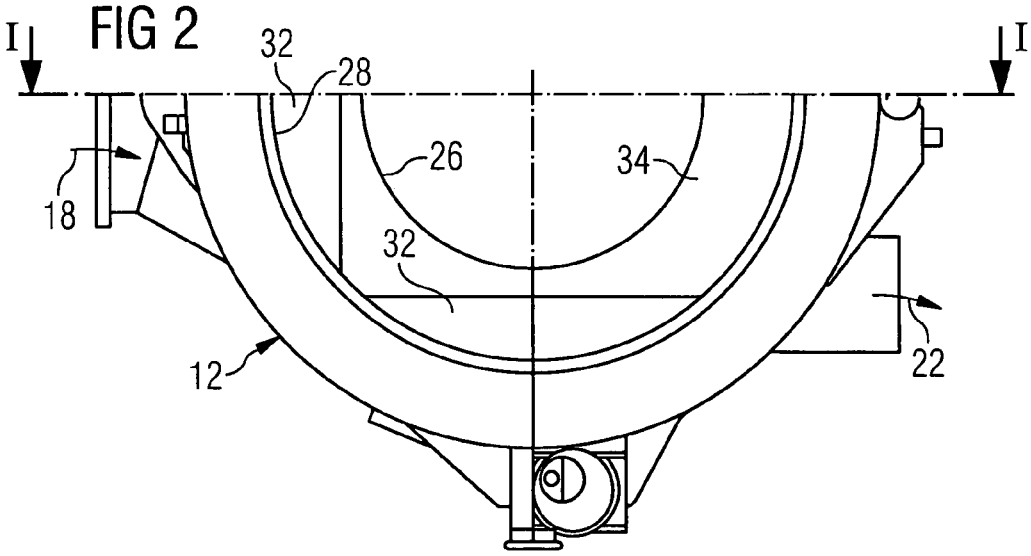
FIG. 2 shows a side view of the casing according to FIG. 1.
Figure 3:
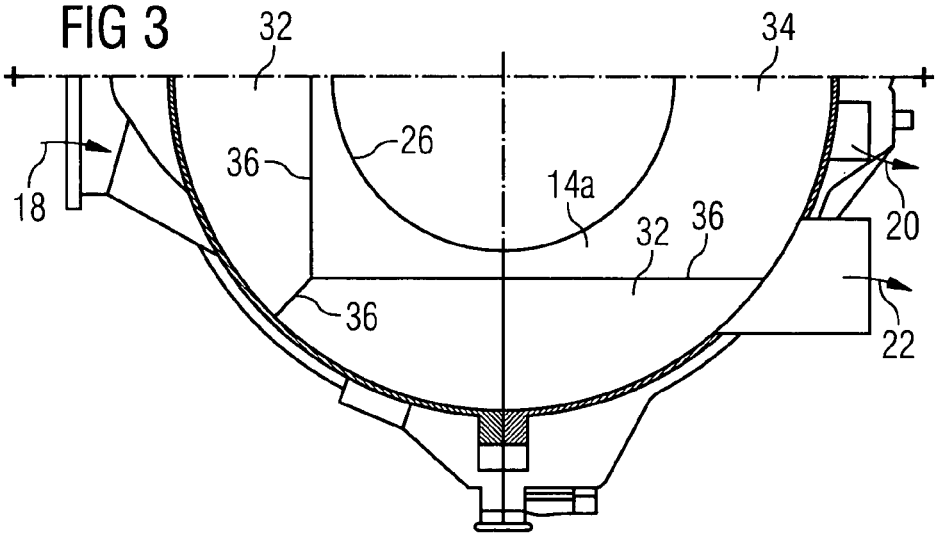
FIG. 3 shows the section III-III in FIG. 1.
Figure 4:
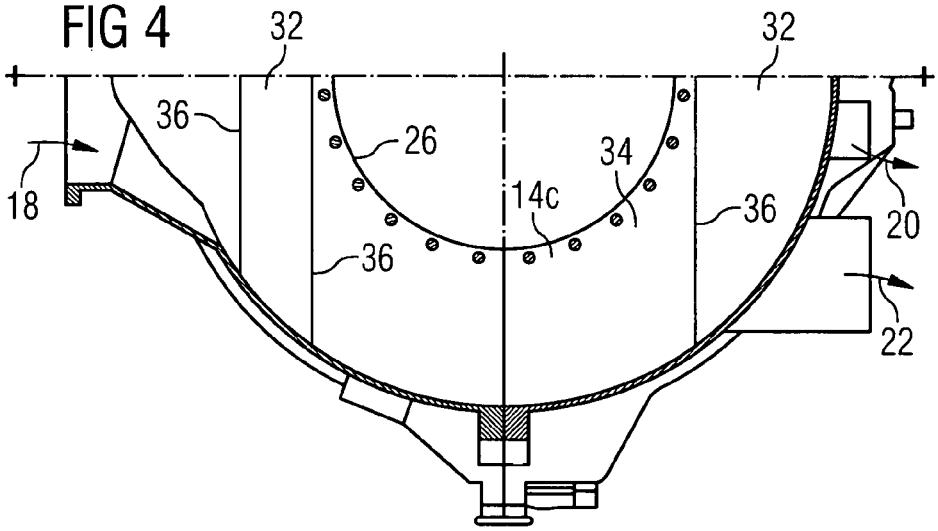
FIG. 4 shows the section IV-IV in FIG. 1.
Figure 5:
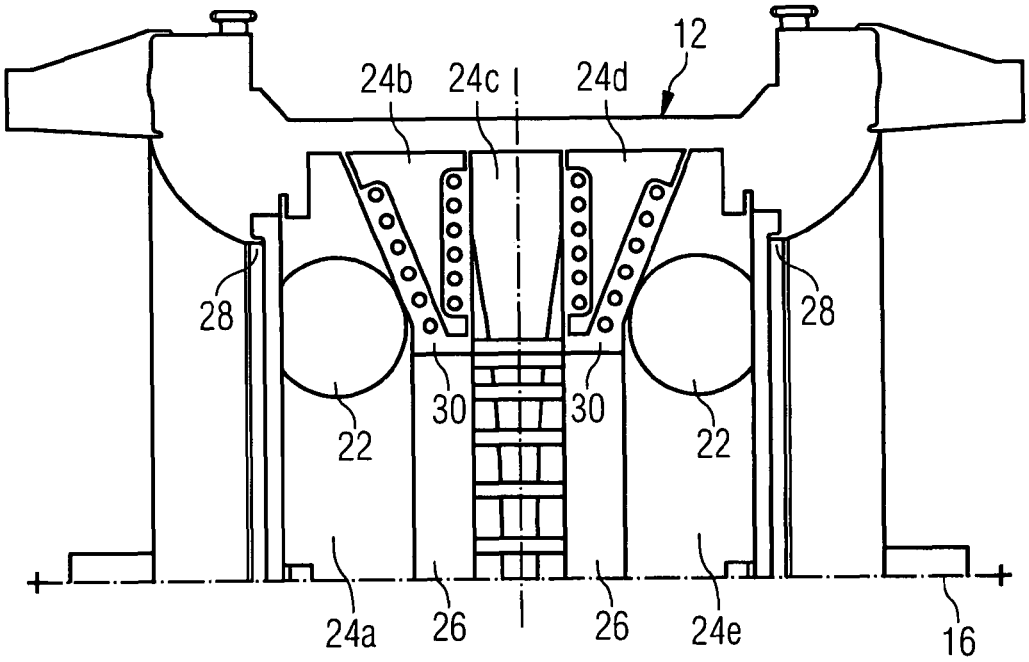
FIG. 5 shows a view of the parting joint of the bottom section of the casing and of the partitions according to FIG. 1.

The elements of a tubular casing 12, and partitions 14*a-d* which are arranged therein, of a steam turbine 10, which are essential for the invention, are illustrated in the figures. The casing 12 is formed basically with a tubular shape along a longitudinal axis 16 and on its external side has a steam inlet 18 in the form of a connector. Steam outlets 20 and 22, which serve as tappings for branching of preheated steam, are also arranged on the external side of the casing 12. The casing 12 is divided by altogether four partitions 14*a*, 14*b*, 14*c* and 14*d* into five steam chambers 24*a* to 24*e*, in which the steam inlet 18 leads into the steam chamber 24*c*, a "small" steam outlet 20 leads out of the steam chambers 24*b* and 24*d* in each case, and two "large" steam outlets 22 lead out of the steam chambers 24*a* and 24*e* in each case.

During operation of the steam turbine 10, a rotor, which is not shown and which is oriented in the direction of the longitudinal axis 16, rotates in the casing 12. This rotor penetrates the partitions 14*a* to 14*d*, for which a central opening 26 is formed in these partitions 14 in each case. The steam which is introduced through the steam inlet 18 into the steam chamber 24*c* flows in this case in an axial direction towards the two end faces of the tubular casing 12 and leaves the casing 12 there through an opening 28 in each case. The flow of steam through the casing 12 is guided in the region of the steam chambers 24*b* and 24*d* through a pipe section 30 in each case, by which pipe section the partitions 14*a* and 14*b*, or 14*c* and 14*d*, as the case may be, are interconnected in the region of the associated openings 26. So that the steam turbine 10 is especially compactly formed in the axial direction, and so that a short distance, which is especially cost-effective to realize, between associated bearings (not shown) of the steam turbine rotor is achieved, and, furthermore, so that the casing 12 and also the partitions 14 are not subjected to excessively large expansion stresses during temperature changes in the steam turbine 10, the partitions 14 are formed in each case from individual, flat, partial surfaces 32 which are arranged in an inclined manner to the longitudinal axis 16 around a central partial surface 34 in each case. The partial surfaces 32, which lie radially on the outside in such a way on the central partial surface 34, adjoin straight crease edges 36 on the central partial surface 34 in each case.

Figure 6:
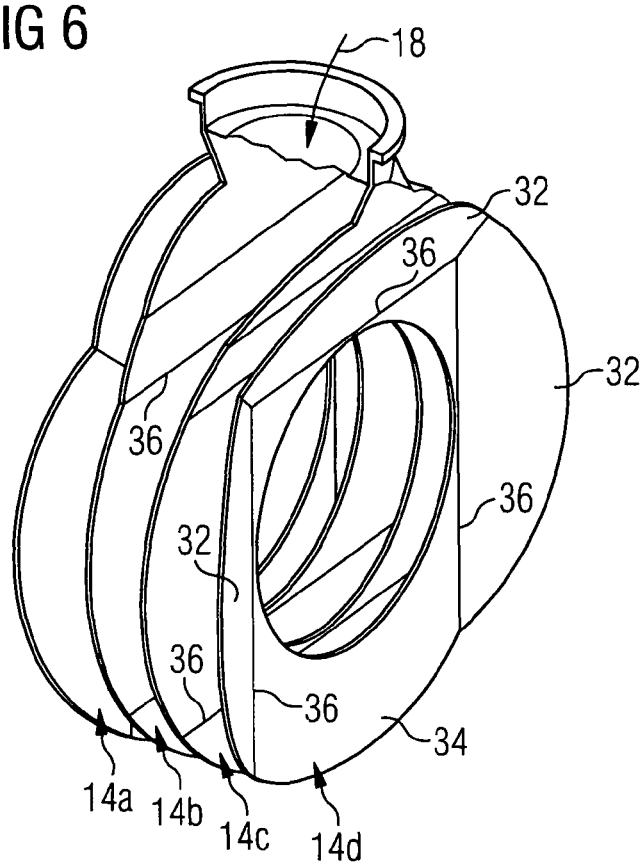
FIG. 6 shows a perspective view of the partitions of the steam turbine according to FIG. 1.
Figure 7:
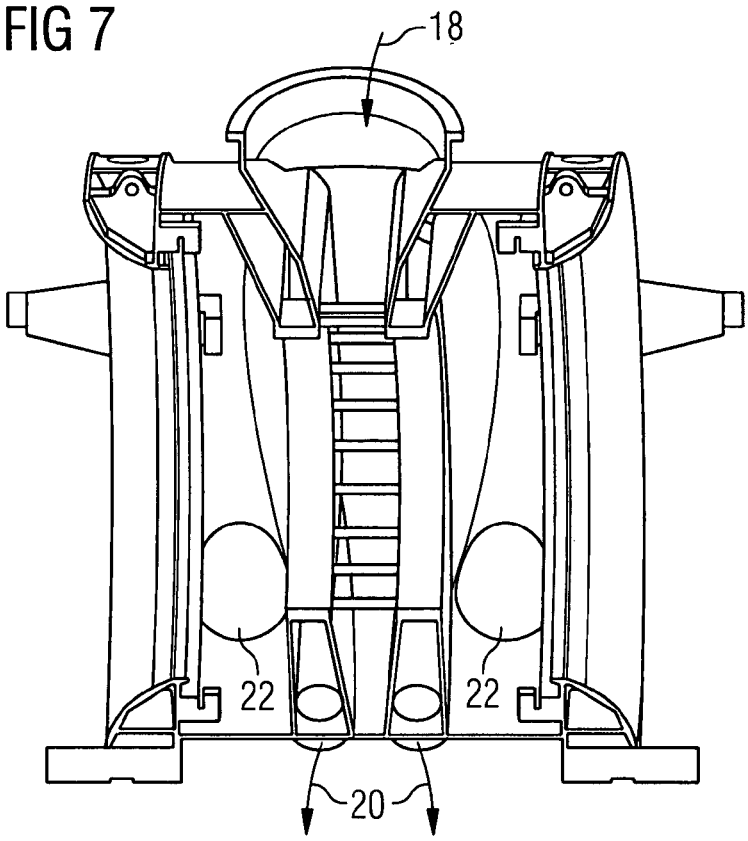
FIG. 7 shows a broken-open perspective view of the casing with partitions according to FIG. 1

As is especially easy to see in FIG. 1, the outer partial surfaces 32 of the steam chamber 24*c* on the side of the steam inlet 18 are inclined in such a way that the steam inlet 18 has reducing cross sectional widths or cross sectional areas, as the case may be, into the casing 12. On the diametrically opposite side of the casing 12, the outer partial surfaces 32 of the partitions 14*b* and 14*c* are inclined to each other in such a way that the cross sectional widths or cross sectional areas of the steam chamber 24*c*, as the case may be, reduce more with increasing distance from the steam inlet 18. The central partial surfaces 34 of the partitions 14*b* and 14*c*, however, are oriented perpendicularly to the longitudinal axis 16. Especially in FIG. 6, it is also to be seen that the central partial surfaces 34 of the partitions 14*b* and 14*c* are continued laterally from the steam inlet 18 in a flat manner up to the casing 12 in each case, and no crease edges are provided there.

Unlike the partitions 14*b* and 14*c*, the partitions 14*a* and 14*d* are formed in each case as "shells", on which three outer partial surfaces 32, which are arranged in an inclined manner, are formed on a central partial surface 34. The outer partial surfaces 32 of the partitions 14*a* and 14*d* are inclined in the axial direction to the end face openings 28 of the associated steam chambers 24*a* and 24*e* in each case. As a result, the upper, outer partial surface 32 of the partitions 14*a* and 14*d* in each case, with regard to FIG. 6, extends basically parallel to the upper, outer partial surfaces 32 of the partitions 14*b* or 14*c*, as the case may be (see also FIG. 1, top half). In the bottom region of the partitions 14, with regard to the figures, a widening of the steam chambers 24*b* and 24*d* in the direction of the "small" steam outlets 20 is achieved by means of the outer partial surfaces 32 of the partitions 14*b* and 14*c*, which are inclined in relation to each other, and by means of the central partial surface 34 of the partitions 14*a* and 14*d*, which surface extends to the bottom perpendicularly to the longitudinal axis 16. Consequently, from the top downwards there results altogether an increase of the cross sectional areas of the annular steam chambers 24*b* and 24*d*, which are bounded towards the middle by means of the pipe section 30, in the direction of the steam outlets 20.

Two steam outlets 22 are provided in each case on the steam chambers 24*a* and 24*e* at the bottom. These steam outlets 22 lie in a region of the steam chambers 24*a* or 24*e*, as the case may be, in which the steam chambers 24*a* and 24*e* are especially wide in the axial direction, owing to the shape of the partitions 14*a* or 14*d*, as the case may be. In the upper and side regions, the steam chambers 24*a* and 24*e*, however, are comparatively narrow owing to the three outer partial surfaces 32 which are grouped on the partitions 14*a* and 14*d* in each case around the central partial surface 34.

Figure 8:
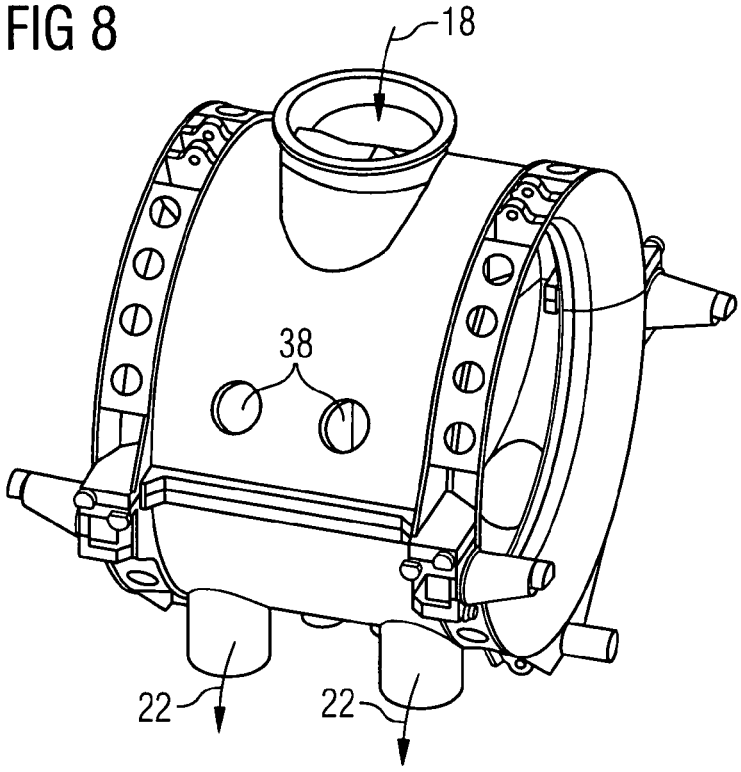
FIG. 8 shows a perspective view of the casing according to FIG. 1 from the outside.

As is shown in FIG. 8, entry openings or manholes 38, as the case may he, are formed on the casing 12 just above the parting joint of the bottom section, which entry openings or manholes, on account of the selected shape of the partitions 14, enable an especially easily accessible entry and a good access to the regions inside the casing 12 which are to be worked.

The invention claimed is:

1. A steam turbine, comprising:

a plurality of steam chambers enclosed by a substantially tubular casing; and a partition arranged in the casing that separates the plurality of steam chambers from each other, wherein the partition is formed by at least two disposed partial surfaces connected to a central partial surface, the at least two partial surfaces are inclined in different directions relative to the central partial surface, wherein the at least two partial surfaces adjoin each other on at least one straight crease edge, and wherein the at least two partial surfaces and the central partial surface adjoin each other on crease edges asymmetrically arranged with regard to a longitudinal axis of the tubular casing.

2. The steam turbine as claimed in claim 1, wherein an inclination of the partial surfaces are asymmetrically arranged relative to a longitudinal axis of the tubular casing.

3. The steam turbine as claimed in claim 2, wherein the inclination of the partial surfaces are not rotationally symmetrically arranged relative to a longitudinal axis of the tubular casing.

4. The steam turbine as claimed in claim 3, wherein the partition is formed with a central partial surface connected to partial surfaces that are distributed over the circumference and are inclined to the central partial surface.

5. The steam turbine as claimed in claim 4, wherein the three inclined partial surfaces are essentially the same size.

6. The steam turbine as claimed in claim 5, wherein the central partial surface on at least one section of its circumference is flat up to the casing.

7. The steam turbine as claimed in claim 6, wherein the central partial surface is oriented essentially perpendicularly to a longitudinal axis of the tubular casing.

8. The steam turbine as claimed in claim 7, wherein an inlet or outlet, which is funnel-shaped on one side, is formed by one of the partial surfaces in the casing.

9. The steam turbine as claimed in claim 1, wherein the partition and at least two connections for steam are formed on the casing such that one of the steam chambers has a decreasing cross sectional area in the direction from an associated connection into the chamber, while the steam chamber located on another side of the partition has an increasing cross sectional area in the direction from an associated connection the chamber.

* * * * *

UNITED STATES PATENT AND TRADEMARK OFFICE

CERTIFICATE OF CORRECTION

PATENT NO. : 8,221,063 B2
APPLICATION NO. : 11/660638
DATED : July 17, 2012
INVENTOR(S) : Max Wiesenberger It is certified that error appears in the above-identified patent and that said Letters Patent is hereby corrected as shown below:

IN THE CLAIMS:
Col. 6, Claim 4, line 15, insert --three-- after connected to
Col. 6, Claim 9, line 36, insert --into-- after connection Signed and Sealed this
Eighteenth Day of December, 2012

David J. Kappos

David J. Kappos
*Director of the United States Patent and Trademark Office*